US005826597A

United States Patent [19]

Chou

[11] Patent Number: 5,826,597

[45] Date of Patent: Oct. 27, 1998

[54] HAIR BAND MADE WITH TWO DIFFERENTLY COLORED PIECES

[76] Inventor: Chi-Hsiung Chou, P.O. Box 90, Tainan City, Taiwan

[21] Appl. No.: 926,688

[22] Filed: Sep. 10, 1997

[51] Int. Cl.[6] ..... A45D 8/14

[52] U.S. Cl. ..... 132/273; 2/174; 2/DIG. 11

[58] Field of Search ..... 132/273, 274; D28/39, 41, 33; 2/174, 171, DIG. 11

[56] References Cited

U.S. PATENT DOCUMENTS 3,211,160 10/1965 Miller ..... 132/275

5,427,123 6/1995 Odenthal ..... 132/275

5,722,437 3/1998 Chang ..... 132/275

FOREIGN PATENT DOCUMENTS 399681 7/1909 France ..... 132/275

*Primary Examiner*—Todd E. Manahan

*Assistant Examiner*—Eduardo C. Robert

[57] ABSTRACT

A hair band made of two differently colored pieces, including a band body and a decorative strip releasably combined with the band body. Thus, various decorative, differently colored strips may be stored to be combined separately with the band body one by one, thereby changing a color and a design of the whole hair band.

2 Claims, 3 Drawing Sheets

HAIR BAND MADE WITH TWO DIFFERENTLY COLORED PIECES

BACKGROUND OF THE INVENTION

This invention concerns a hair band made of two differently colored pieces, particularly having a decorative strip releasably combined with a band body for altering the decorative strips differently colored to be combined with the band body and thus changing a color and a design of the whole hair band.

Common conventional hair bands are generally made of elastic plastics formed integral, having a single color. If a different color and design is wanted for a hair band, many separate hair bands respectively provided with different colors and designs should be bought. Then it is a burden for consumers, although hair bands do not cost very much.

SUMMARY OF THE INVENTION

The purpose of the invention is to offer a hair band that is changeable in its color and design by altering a decorative strip releasably combined with the band body.

A feature of the present invention is a band body and a decorative strip releasably fitted in a center lengthwise hole of the band body. The band body has two lengthwise grooved edges and a plurality of bridges connected between the two grooved edges for the decorative strip to lie thereon, and two engage recesses near two ends of the center long hole for two engage ends of the decorative strip to engage so as to permit the decorative strip to be releasably combined with the band body in a closed secure way. Then a decorative strip with a kind of color and design may be replaced with another decorative strip with another kind of color and design, thus changing a color and a design of the whole hair band.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
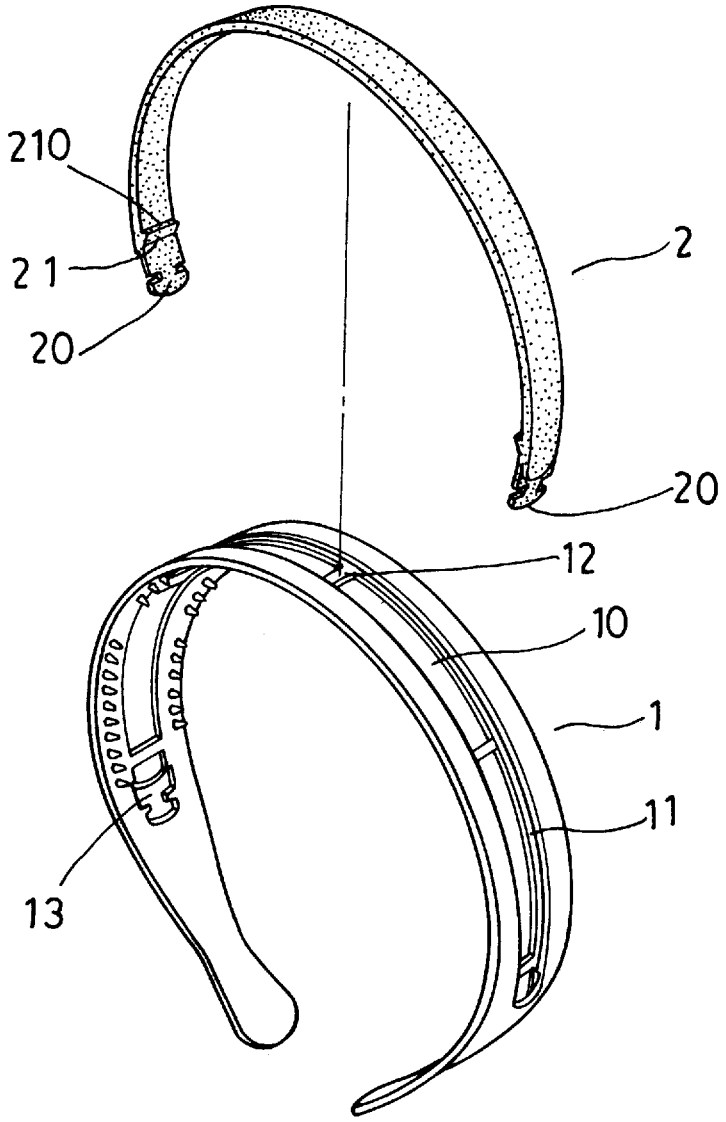
FIG. 1 is an exploded perspective view of a hair band made of two pieces differently colored pieces in the present invention.

A preferred embodiment of a hair band made of two differently colored pieces in the present invention, as shown in FIG. 1, includes a band body 1 and a decorative strip 2 combined together.

The band body 1 is formed to curve for about more than a half circle, having a center lengthwise long hole 10 extending substantially in the band body, a lengthwise grooved edge 11 respectively formed in two opposite sides of the long hole 10, a plurality of lateral bridges 12 connecting the two opposite grooves edges 11, 11 and equidistantly spaced apart, an engaging recess 13 respectively provided in an inner surface near two ends of the long hole 10.

The decorative strip 2 is also curved in the same way as the band body 1, having two opposite engaging ends 20, 20 to correspond to and engage with the two engaging recesses 13 of the band body 1, a stop ridge 21 respectively formed a little away inside the engaging end 20 and having teeth and an inclined stop face 210 comprising a sloping face and a face perpendicular to the inside side of the decorative striping inward.

Figure 2:
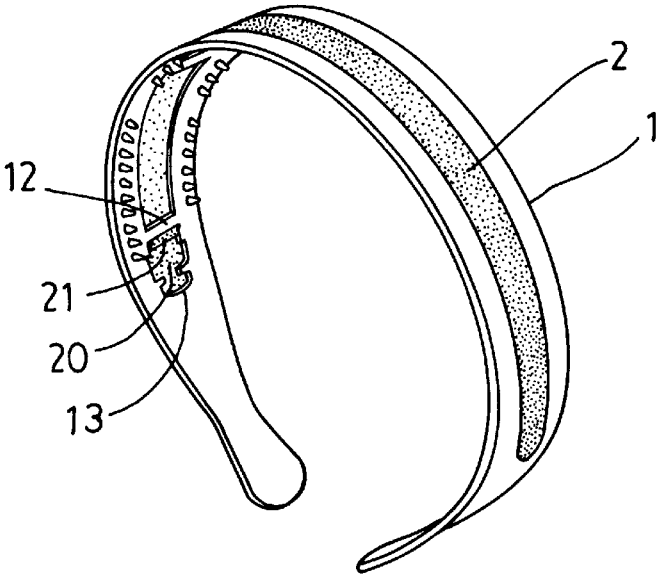
FIG. 2 is a perspective view of the hair band made of two pieces differently colored pieces in the present invention.
Figure 3:
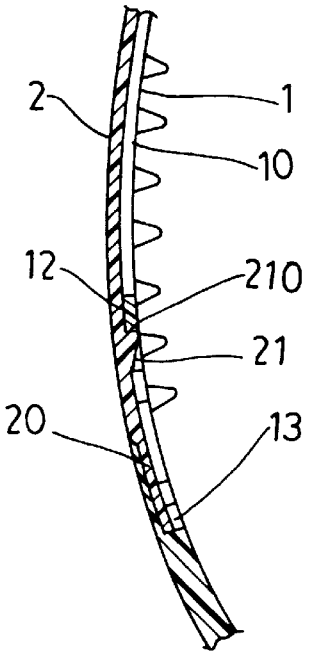
FIG. 3 is a cross-sectional view of the hair band made of two differently colored pieces in the present invention.

During assembly, referring to FIGS. 2 and 3, the decorative strip 2 is fitted in the long hole 20 with one end first fitted therein, and with one engaging end 20 flatly engaging in one engaging recess 13 of the band body 1 with the stop face 210 of the stop ridge 21 engaging a side edge of the nearest bridge 12 to the engaging recess 13, with two opposite lengthwise sides fitting in the grooved edges 11, 11, and with the bottom side supported on the bridges 12. Then the other engaging end 20 of the decorative strip 2 is inclinedly inserted and engaged in the engaging recess 13 at the other end of the band body 1, with the stop face 210 of the stop ridge 21 engaging the side edge of a nearest bridge 12. This completes the assembly of the hair band.

In using this hair band, referring to FIGS. 2 and 3, one of a plurality of differently colored decorative strips 2 is chosen and fitted in the long hole 10 and fixedly retained therein by means of the stop faces 210, 210 of the stop ridges 21, 21 engaging the side edges of the bridges 12 and with the two opposite engaging ends 20, 20 engaging in the engaging holes 13,. 13. Then the decorative strip 2 can not easily fall off the band body 1, even if the band body 1 should be pressed to alter its curvature.

Figure 4:
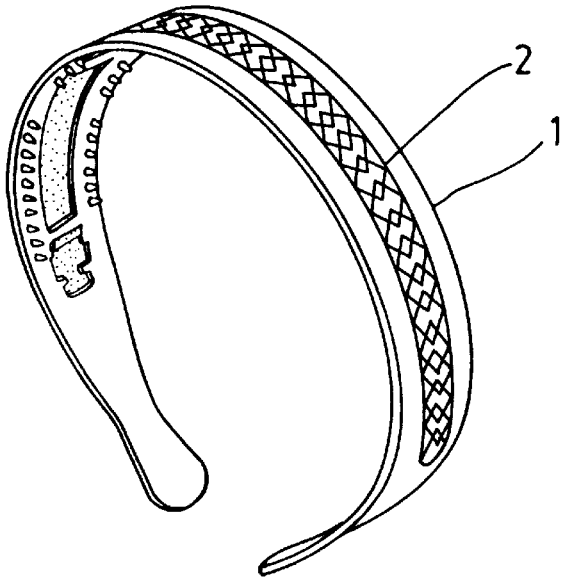
FIG. 4 is a perspective view of the hair band with a different decorative strip in the present invention; and, FIG. 5 is a perspective view of the hair band with another different decorative strip in the present invention.
Figure 5:
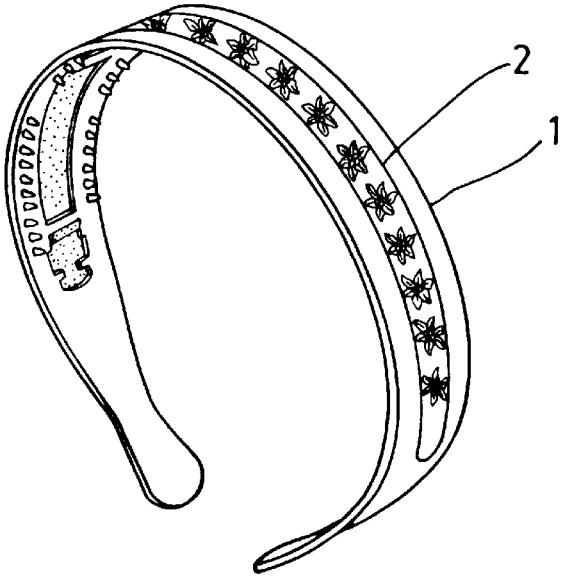

In releasing the decorative strip 2 from the band body 2, the two stop ridges 21, 21 are pressed to force the engaging ends 20, 20 disengaging from the engaging holes 13, 13 (one of the two engaging ends pressed from outside of the decorative strip 2 and the other engaging end pressed from inside of the center lengthwise hole 10), with one end 20 not completely leaving one of the engaging hole 13. Then the end 20 is inclinedly pulled out of the engaging hole 13, letting the decorative strip be removed completely from the center lengthwise hole 10 of the band body 2. Therefore, one of various decorative strips 2 can be chosen to be combined with the band body 1, changing a color and a picture of the same hair band, as shown in FIGS. 4 and 5.

It is obvious that the present invention has several advantages as follows:

1. The decorative strip can be releasably and securely combined with the band body, even if the band body might be compressed to change its curvature.
2. Releasing the decorative strip from the band body after fitted with the band body is simple and quick.
3. Various colored decorative strips may be stored for combining with the band body, altering a color and a design of the whole hair band.
4. Provision of the grooved edges and the bridges in the band body enables the decorative strip combined with the band body closely and securely, letting the both appears to be integral.

While the preferred embodiment of the invention has been described above, it will be recognized and understood that various modifications may be made therein and the appended claims are intended to cover all such modifications which may fall within the spirit and scope of the invention.

What is claimed is:

1. A hair band made of two differently colored pieces comprising:

a body having a center lengthwise long hole extending substantially therein and said center lengthwise long hole having two ends, a lengthwise grooved edge formed in two lengthwise sides of said center lengthwise long hole, a plurality of bridges formed between said two lengthwise grooved edges said bridges being equidistantly spaced apart from one another such that each end of said center lengthwise long hole has a bridge, spaced from, and adjacent thereto, and an engaging recess formed in an inner surface near each of the two ends of the center lengthwise hole; and a decorative strip fitting in said center lengthwise long hole of said body and engaging said two lengthwise grooved edges and lying on said bridges of said body, said decorative strip having two opposite ends each engaging a respective one of said two engaging recesses of said body and a stop ridge on an inside of each of said ends; each stop ridge engaging a side of the bridge adjacent to the respective end of said center lengthwise long hole.

2. The hair band made of two differently colored pieces as claimed in claim 1, wherein each stop ridge is provided with a sloping face and a face perpendicular to the inside side of said end of said decorative strip.

* * * * *